US005647512A

United States Patent [19]

Assis Mascarenhas de Oliveira et al.

[11] Patent Number: 5,647,512

[45] Date of Patent: Jul. 15, 1997

[54] SODA DISPENSING MACHINE

[75] Inventors: Carlos Henrique Assis Mascarenhas de Oliveira; Leonardo Bruno; Roberto Padilla Julio; Alberto Maselli; Ivan Jerônimo Moraes Mesiano, all of São Paulo, Brazil

[73] Assignee: Spal Indústria Brasileira de Bebidas S/A, São Paulo, Brazil

[21] Appl. No.: 535,114

[22] PCT Filed: Mar. 2, 1995

[86] PCT No.: PCT/BR95/00015

§ 371 Date: Feb. 12, 1996

§ 102(e) Date: Feb. 12, 1996

[87] PCT Pub. No.: WO95/23760

PCT Pub. Date: Sep. 8, 1995

[30] Foreign Application Priority Data

Mar. 4, 1994 [BR] Brazil ..... 7400414-0 U

[51] Int. Cl.[6] ..... B67D 5/56

[52] U.S. Cl. ..... 222/108; 222/129.1; 222/146.6

[58] Field of Search ..... 222/108, 129.1–129.4, 222/146.6, 396, 397

[56] References Cited

U.S. PATENT DOCUMENTS

| | | | |
|---|---|---|---|
| 2,463,899 | 3/1949 | Nicholas . | |
| 3,892,335 | 7/1975 | Schroeder | 222/146.6 X |
| 4,781,310 | 11/1988 | Credle, Jr. et al. | 222/146.6 X |
| 5,124,088 | 6/1992 | Stumphauzer | 222/129.1 X |
| 5,190,189 | 3/1993 | Zimmer et al. | 222/146.6 X |
| 5,234,131 | 8/1993 | Griffin | 222/146.6 |
| 5,499,744 | 3/1996 | Hawkins | 222/146.6 X |

FOREIGN PATENT DOCUMENTS

| | | | |
|---|---|---|---|
| 0 364 206 | 4/1990 | European Pat. Off. | 222/129.1 |
| 2194508 | 3/1988 | United Kingdom | 222/146.6 |
| 2247848 | 3/1992 | United Kingdom . | |
| WO93/15997 | 8/1993 | WIPO | 222/146.6 |

*Primary Examiner*—Andres Kashnikow
*Assistant Examiner*—Kenneth Bomberg
*Attorney, Agent, or Firm*—Darby & Darby

[57] ABSTRACT

A soda dispensing machine comprising a basic body (10), including a tank (11) containing immersion water (A), in which there are immersed: an evaporator (21) of a refrigerating unit (20); a coil basket (30), disposed inside the evaporator (21) and including at least one gasified water coil (31); a carbonator (40), which is connected with respective sources of carbonic gas and potable water, which are mixed by the carbonator, so as to obtain gasified water, the coil (31) being provided with gasified water and air, which is purged through a drain valve (41) in fluid communication with the carbonator (40), the peripheral surface of the evaporator (21) being adjacently disposed in relation to the peripheral surface of the tank (11), the carbonator (40) being disposed inside the evaporator (21), the drain valve (41) of the carbonator being disposed externally in relation to the basic body (10).

3 Claims, 2 Drawing Sheets

SODA DISPENSING MACHINE

FIELD OF THE INVENTION

The present invention refers, in general, to a new constructive arrangement for a soda dispensing machine, and more particularly, to a modification and repositioning of the carbonator in said machine, in order to make said machine be thermically more efficient and consequently more economical and durable, since the compressor of its refrigerating system will work during shorter periods, between longer intervals of time.

BACKGROUND OF THE INVENTION

The machine for dispensing sodas or gasified beverages, such as soft drinks, basically comprises at least one water reservoir and at least one syrup (beverage concentrate) reservoir. The water and syrup flows are independent from each other and refrigerated by an adequate refrigerating system provided at the operational unit of the machine. The water passes through a carbonator, which consists of a refrigerated chamber containing pressurized carbonic gas, which is dissolved in the water, gasifying said water. The gasified water and syrup travel through respective coils, till they reach a dispensing valve, which releases a peripheral flow of gasified water and a central flow of syrup. Said flows are at about 4° C. and mixed in the consumption container, such as a glass.

The operational unit of a soda dispensing machine carries, within a cabinet provided with a lid, a tank containing water, in which there are submersed: the evaporator of a refrigerating unit disposed above the tank; the carbonated water and syrup coils, attached to a coil support or basket; the carbonator; and a stirrer, to provide the circulation of the immersion water in said tank.

In the known soda dispensing machines, the evaporator, which has a generally substantially parallepipedal shape with a square base, is disposed inside the tank, in order to present at least one of its lateral surfaces spaced from the adjacent tank wall, in such a way as to allow the carbonator to be disposed therebetween. The coil basket is peripherally disposed inside the evaporator, with the stirrer being geometrically disposed in the center of the coil basket.

The immersion water of the tank is refrigerated by the evaporator. For this purpose, the evaporator forms on the surface thereof an ice layer, which is melted by said water, the latter transferring to the ice layer an amount of heat corresponding to the latent heat of fusion of the ice, thereby cooling said water.

The several flows, i.e., the water and carbonic gas flows, which are fed to the carbonator, the gasified water flow, supplied by said carbonator and the syrup flows are refrigerated, by immersing the respective tubes and coils in the water of the tank, while the carbonator is refrigerated by a water flow projected through the evaporator against said carbonator, by action of the stirrer.

A good soda should present an adequate level of dissolved gas, so as not to transmit to the consumer the sensation of being flat. Such satisfactory level of gasification basically depends on the perfect operational conditions of the carbonator which, besides receiving the adequately cooled flows of water and carbonic gas, should itself be perfectly cooled.

Such condition is not always fully reached in the prior art equipment. The fact that the carbonator is disposed externally to the evaporator already provides an unfavorable operational condition, since this region is hotter than the inside of the evaporator, usually causing an overpressure inside the carbonator, resulting in the activation of a drain valve, which is disposed on the top thereof, and which liberates an excess of water-air-carbonic gas mixture, to be explained ahead. This drawback, together with a consequent undesirable loss of carbonic gas, is usually minimized by overdimensioning the refrigerating system. Such machines further present a second drawback. When the machine is switched on, but not used for a long period of time, a thick ice layer is formed around the evaporator, creating a barrier to the flow of water from the tank through the evaporator, preventing the carbonator from being adequately refrigerated when the machine is used again to deliver the soda. It should be noted that this problem will be even greater when the refrigerating system is overdimensioned, with the aim to solve the first drawback mentioned above.

Generally, the water to be gasified enters the carbonator, carrying therewith an amount of dissolved air. Since this air is lighter than the carbonic gas, it will be displaced by the latter during the water gasification, accumulating on the top of the carbonator. In order to avoid the air to occupy a large space in the carbonator, preventing the latter from working adequately and avoiding the precise water gasification, the above cited drain valve is manually activated, so as to allow the purgation of said accumulated air.

The arrangement of said valve on the top of the carbonator in the known machines generates additional problems: the purged air carries a large amount of water, which constitutes a potential source of short-circuits when in contact with the electrical system inside the machine. Moreover, said valve is of difficult access, requiring the removal of the external lid of the appliance to be operated.

DISCLOSURE OF THE INVENTION

Thus, it is an object of the present invention to provide a constructive arrangement for a soda dispensing machine, which allows to achieve an optimized thermal yielding, as well as a constant level of water gasification.

It is a further object of the present invention to provide a constructive arrangement as described above, which allows an easy access and safe handling of the purging means thereof.

These and other objectives and advantages of the present invention are achieved through the provision of a constructive arrangement of a soda dispensing machine of the type comprising a basic body, including a tank containing immersion water, in which there are immersed: an evaporator, which refrigerates the immersion water; a coil basket, disposed inside the evaporator and including at least one coil of gasified water; a carbonator, connected with respective sources of carbonic gas and potable water, which are mixed by said carbonator, so as to obtain gasified water, said coil being provided with gasified water and air, which is purged through a drain valve in fluid communication with said carbonator.

According to the invention, the peripheral surface of the evaporator is adjacently disposed relative to the peripheral surface of the tank, said carbonator being disposed inside said evaporator and the drain valve of said carbonator being disposed externally in relation to the basic body.

The carbonator of a soda dispensing machine, when disposed inside the evaporator according to the present invention, is efficiently and evenly refrigerated in any operative conditions of the machine. The improvement obtained with such innovation is specially evidenced in extreme operative conditions, such as when the machine is used again, after long non-use periods, which cause the formation of a thick ice layer around the evaporator. As the carbonator is located at the region with cooler water, it can gasify the water perfectly well, since the very first moments of the machine delivering operation.

As a further consequence of this improvement, the internal overpressure of the carbonator is substantially eliminated, thus avoiding the spontaneous actuation of its drain valve, as well as the consequent losses of carbonic gas and undesirable wetting of the electrical system with the drawn waters.

In a second aspect, the present invention provides the positioning of the drain valve of the carbonator externally to the machine. Besides eliminating the trouble of removing the external lid of the appliance at each periodical operation of purging the amount of air formed on the top of the carbonator, such operation becomes substantially safer because there is no risk of the water, which is drawn by the purged air, of falling over the electrical system of the appliance, causing short-circuits.

BRIEF DESCRIPTION OF THE DRAWINGS

The invention will be described below, with reference to the attached drawings, in which.

BEST MODE FOR CARRYING OUT THE INVENTION

Figure 1:
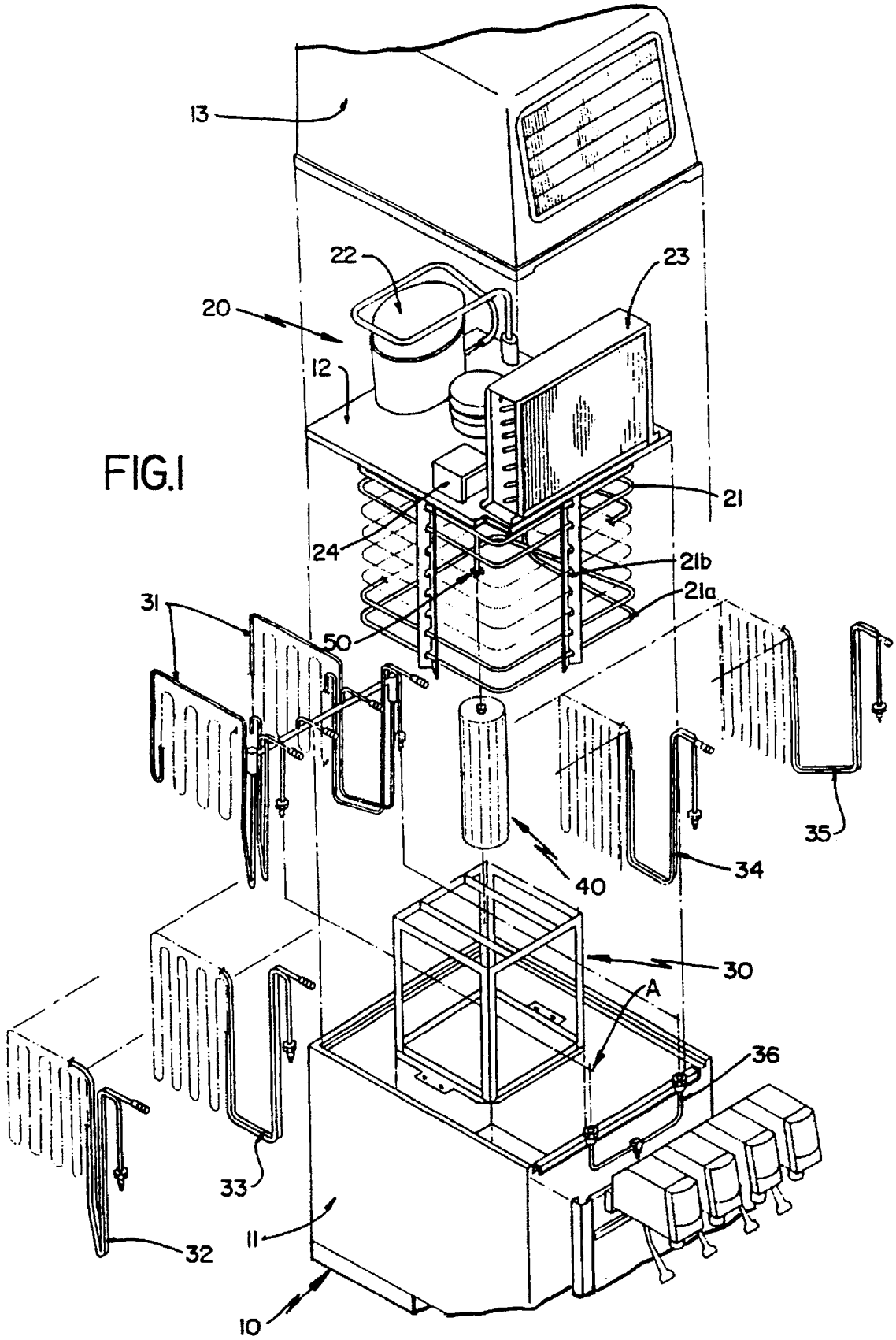
FIG. 1 is an exploded perspective view of a soda dispensing machine, according to the present invention.
Figure 2:
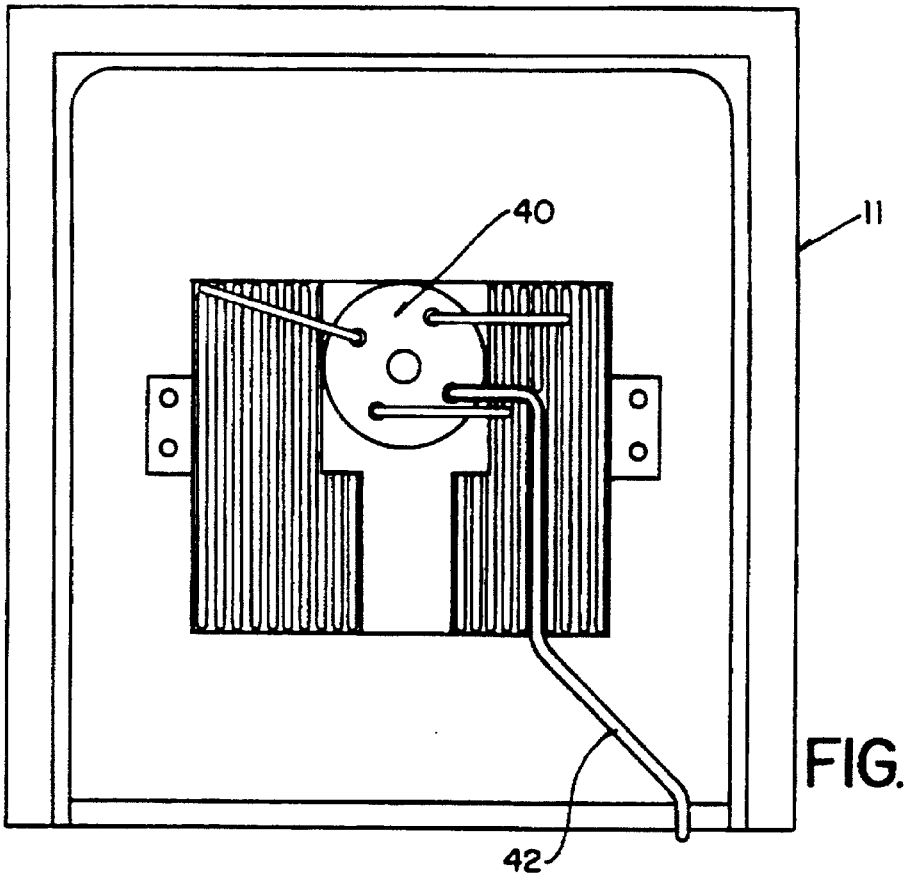
FIG. 2 is a top schematic view of the tank of the soda dispensing machine illustrated in FIG. 1, showing the carbonator provided with a tube, which is connected with the drain valve, disposed externally to the equipment.
Figure 3:
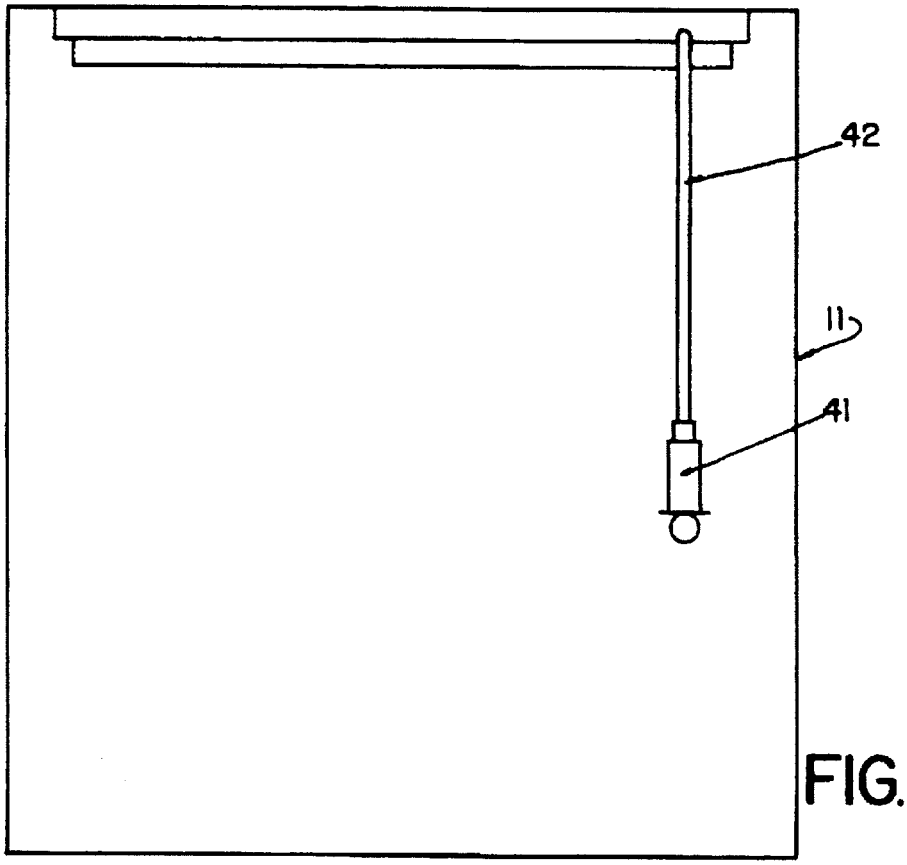
FIG. 3 is a frontal elevational view of the machine, without the refrigerating unit and the lid, showing the arrangement of the drain valve of the carbonator.

According to the figures described above, the soda dispensing machine comprises a basic body 10, which includes a tank 11, having a substantially parallepipedal shape with a square base, a supporting plate 12 seated onto said tank and carrying a refrigerating unit 20, including a compressor 22, a condenser 23 and an electronic control box 24.

Said supporting plate 12 further carries the motor 51 of a stirrer 50, whose function will be defined ahead. The basic body 10 further includes a lid 13, preferably in a reinforced plastic material, such as polyesther with a fiberglass reinforcement. Said lid 13 covers the plate 12 and consequently the elements attached thereto.

The tank 11 is filled up with an amount of immersion water A, sufficient to completely cover the several elements disposed inside said tank 11, i.e., the evaporator 21 of the refrigerating unit 20, a coil support or basket 30, a carbonator 40 and the already mentioned stirrer 50.

The evaporator 21 comprises a structure defined by a plurality of horizontal tubular frames 21*a*, which are fixed at the median portions of the sides thereof into spacedly disposed orifices of corresponding columns 21*b*, which are fixed at the upper portion thereof to the supporting plate 12 and seated on the bottom of the tank 11. The external dimensions of said evaporator 21 are slightly smaller than the internal dimensions of the tank 11, i.e., the sides of the frames 21*a* are disposed adjacently to the corresponding lateral walls of the tank 11.

During the operation of the refrigerating unit 20, there is formed on the surface of the tubular frames 21*a* of the evaporator 21 an ice layer, which will absorb an amount of heat from the immersion water A, corresponding to the latent heat of fusion of the ice, thus refrigerating said immersion water A preferably at a temperature of about 4° C.

Such arrangement of the evaporator 21 represents a substantial improvement for this type of equipment. Since substantially the whole amount of immersion water A is located inside the evaporator 21, there is eliminated the great difference between the temperatures of the external and internal waters of the evaporator in the known constructions, said waters being restrained from circulating and becoming homogenized, due to the ice barrier formed on the evaporator after long non-use periods of the machine. The temperature of the water is homogenized when said water is stirred by the stirrer 50 which, for maximum yielding, is substantially disposed in the center of the tank 11. Said immersion water A, which is homogeneously distributed in the tank 11 at about 0° C., will refrigerate the elements contained in said tank 11 and consequently the liquid masses flowing through said elements, to be described below.

The coil basket 30 is defined by a metallic structure, which is substantially cubic and mounted at the bottom of the tank 11 and to which are fixed the liquid coils, which comprise at least one, but preferably two carbonated water coils 31 and usually four syrup coils 32, 33, 34 and 35, each conducting a syrup or concentrate of a corresponding soda from the assortment distributed by the machine.

The syrup coils 32, 33, 34, 35 are connected, at one end, with the corresponding syrup tanks, not illustrated, which feed said coils and, at the other end, each coil 32, 33, 34, 35 feeds a corresponding soda dispensing valve, not illustrated either.

The carbonator 40 receives, from an adequate source and through a tube immersed in the immersion water A, a flow of cold potable water, which is mixed under pressure with a flow of carbonic gas, in order to dissolve said gas into said water, producing a carbonated water, which is distributed, through a carbonated water collector 36, to the carbonated water coils 31. Each of said coils feeds two soda dispensing valves.

Each soda dispensing valve liberates a central flow of syrup and a peripheral flow of carbonated water, the mixture of both flows occurring inside the container, where the soda is finally formed.

In order to permit the purgation of the carbonator 40, there is provided, externally to the tank 11 and preferably at the external surface of its back wall, a drain valve 41, which is connected with the top of the carbonator 40 through a tube 42.

The proposed constructive arrangement, besides providing an even and efficient refrigeration of the carbonator 40, resulting in a constant level of water carbonation i.e., in a good quality and homogeneous soda, avoids overpressures inside said carbonator and, consequently, the undesirable spontaneous actuations of its drain valve 41. Moreover, the positioning of said valve outside the machine avoids the wettings and risks of short circuits that usually occur in the known soda dispensing machines.

We claim:

1. A soda dispensing machine, of the type comprising a basic body (10), including a tank (11) containing immersion water (A), in which there are immersed: an evaporator (21) of a refrigerating unit (20); a coil basket (30), disposed inside the evaporator (21) and including at least one gasified water coil (31); a carbonator (40), which is connected with respective sources of carbonic gas and potable water, which are mixed by said carbonator, so as to obtain gasified water, said coil (31) being provided with gasified water and air, which is purged through a drain valve (41) in fluid communication with said carbonator (40), characterized in that the peripheral surface of the evaporator (21) is adjacently disposed in relation to the peripheral surface of the tank (11), the carbonator (40) being disposed inside said evaporator (21), the drain valve (41) of said carbonator being disposed externally in relation to the basic body (10).

2. Machine, according to claim 1, characterized in that the drain valve (41) is fixed to the external surface of the front wall of the tank (11).

3. Machine, according to claim 1, characterized in that the drain valve (41) is connected with the carbonator (40) through a tube (42).

* * * * *

UNITED STATES PATENT AND TRADEMARK OFFICE

CERTIFICATE OF CORRECTION

PATENT NO. : 5,647,512

DATED : July 15, 1997

INVENTOR(S) : Assis Mascarenhas de Oliveira et al

It is certified that error appears in the above-indentified patent and that said Letters Patent is hereby corrected as shown below:

In the cover page of the patent, Section [30], please delete "Brazil 7400414-0 U" and substitute therefor --Brazil MU 7400414-0 --.

Signed and Sealed this

Twenty-third Day of September, 1997

*Attest:*

*Attesting Officer*

BRUCE LEHMAN

*Commissioner of Patents and Trademarks*